US007998043B2

(12) United States Patent
Zhou et al.

(10) Patent No.: US 7,998,043 B2
(45) Date of Patent: Aug. 16, 2011

(54) PROSTRATE GRABBLING EXERCISE APPARATUS

(75) Inventors: Lisha Zhou, Zhuzhou (CN); Minghu Rao, Howick (AU)

(73) Assignee: Fitcrawl (Shanghai) Industry Co., Ltd., Shanghai (CN)

( * ) Notice: Subject to any disclaimer, the term of this patent is extended or adjusted under 35 U.S.C. 154(b) by 0 days.

(21) Appl. No.: 12/665,257

(22) PCT Filed: Jul. 7, 2008

(86) PCT No.: PCT/CN2008/071570

§ 371 (c)(1), (2), (4) Date: Dec. 17, 2009

(87) PCT Pub. No.: WO2009/079937

PCT Pub. Date: Jul. 2, 2009

(65) Prior Publication Data

US 2010/0248919 A1 Sep. 30, 2010

(30) Foreign Application Priority Data

Dec. 18, 2007 (CN) ..... 2007 1 0192645

(51) Int. Cl.
*A63B 71/00* (2006.01)

(52) U.S. Cl. ..... 482/139

(58) Field of Classification Search ..... 482/139, 482/148, 907, 91, 70–72, 79, 51, 62, 66, 482/146

See application file for complete search history.

(56) References Cited

U.S. PATENT DOCUMENTS

| | | | | |
|---|---|---|---|---|
| 3,589,720 | A * | 6/1971 | Agamian | 482/114 |
| 4,529,194 | A * | 7/1985 | Haaheim | 482/70 |
| 4,679,786 | A * | 7/1987 | Rodgers | 482/70 |
| 4,867,443 | A * | 9/1989 | Jensen | 482/70 |
| 5,203,751 | A * | 4/1993 | Chang | 482/70 |
| 5,607,374 | A | 3/1997 | Hesse | |
| 6,514,180 | B1 * | 2/2003 | Rawls | 482/70 |
| 6,786,850 | B2 * | 9/2004 | Nizamuddin | 482/51 |
| 6,805,657 | B2 | 10/2004 | Trenary | |
| 6,942,605 | B1 * | 9/2005 | Sukhovitsky | 482/132 |
| 7,338,441 | B2 * | 3/2008 | Houser et al. | 600/206 |
| 7,556,592 | B2 * | 7/2009 | Nizam | 482/70 |

FOREIGN PATENT DOCUMENTS

| | | | |
|---|---|---|---|
| CN | 1267560 | A | 9/2000 |
| CN | 2448407 | Y | 9/2001 |
| CN | 2403451 | Y | 11/2001 |
| CN | 101181662 | A | 5/2008 |

* cited by examiner

*Primary Examiner* — Lori Baker

(74) *Attorney, Agent, or Firm* — Matthias Scholl P.C.; Matthias Scholl

(57) ABSTRACT

A prone crawling exerciser comprises upper limp support, left and right leg slides, track means and pulley and cable means, wherein, left and right leg slides each is mounted with wheels; track means comprises two parallel left and right tracks and track brackets, left and right tracks mounted on track brackets with a space from ground, upper limp support located on left and right track or track brackets; left and right leg slides are mounted on left and right tracks and are able to slide on left and right tracks through said wheels; pulley and cable means comprises pulley and cable, said pulleys mounted on track means, said cable reeving about said pulleys connecting at least left and right leg slides. This invention enables users to simulate an animal prone crawling motion. With its adjustable loading, it is suitable for various kinds of users with different physique and age, even for the upper limb disabled person. The user can specifically exercise his lower back and abdomen, pelvis and lower limbs with different load.

18 Claims, 5 Drawing Sheets

PROSTRATE GRABBLING EXERCISE APPARATUS

CROSS-REFERENCE TO RELATED APPLICATIONS

This Application is the US National Phase under 35 U.S.C. §371 of International Application No. PCT/CN2008/071570, filed Jul. 7, 2008, which was published in Chinese as International Publication No. WO/2009/079937 on Jul. 2, 2009, and claims the benefit of CN 200710192645.X, filed Dec. 18, 2007.

FIELD OF THE INVENTION

The present invention relates to exercise equipment and device and particularly to a prone crawling exerciser permitting a user to simulate crawling motion.

BACKGROUND OF THE INVENTION

At present, simulating an animal to perform a prone crawling motion is a new type of exercise and fitness method which becomes more popular in some countries. The main principles and functions that performing crawling movement can achieve good fitness effects may be explained as follows.

The essential difference between humanity and animal is that humanity is able to stand and walk erectly but animal is not. However, comparing with the animal which crawls with its four limbs, the humanity who stands and walks erectly has some defects in human body itself, among them the following two defects may be the essential.

First, the load condition of spine is unreasonable. The spine in human body is mainly composed of the cervical vertebra, the thoracic vertebra, the lumbar vertebra, the sacrum and the coccyx. From the mechanics of spine structure, human is not suitable for walking erectly. When human stands erectly, the weight of the head is mainly borne by the cervical vertebra and the weight of the upper body is almost entirely borne by the lumbar vertebra. Under the heavy load for a long time, the spine would easily produce distortion, dislocation, proliferation and prominent intervertebral disc and result in diseases. It can be seen that more and more people suffer from the cervical vertebra sickness, the lumbar vertebra sickness, the strain of lumbar muscles and various other kind of diseases related to spine.

Second, the blood flow direction is unreasonable. When human walks erectly, his trunk is vertical to the Earth. The blood flow direction from heart to brain is vertically upward. Owing to the gravity, the cardiovascular system consumes much more energy to move the blood. The blood returns from lower limb to heart is also difficult. Therefore, human tends to have the heart and brain blood vessel diseases.

However the crawling movement could change the unreasonable situations and overcome the defects owing to erect walk.

First, the mechanics structure and the load condition of spine could be changed in crawling pose. When crawling, the weight of whole body distributes to four limbs, therefore the load to the cervical vertebra, the thoracic vertebra and the lumbar vertebra would be reduced greatly. More importantly, when crawling, the spine restores to the reasonable mechanics structure condition. In other words, the spine is in its natural, free and relaxed S shaped horizontal position. In this position cervical vertebra, the thoracic vertebra and the lumbar vertebra are restored the normal physiological and anatomical structure position. Therefore, the diseases related to spine such as strain of lumbar muscles, the sciatica, the cervical vertebra sickness and the lumbar vertebra could be prevented or treated.

Second, the blood flow direction could be changed in crawling pose. When crawling, the blood flow direction from heart to head is nearly in parallel line with the horizon. At the same time, the majority of blood in whole body is nearly in same level with the heart. Compared with the vertical flowing of blood when standing or walking, the horizontal flowing of blood when crawling would be obviously more free and smooth, the artery and vein circulation would be more unobstructed, more sufficient, so the cardiovascular system does not have to consume more energy to satisfy the blood nutrition need in various parts of the human body, thus the work load of cardiovascular system is reduced greatly. This is beneficial to prevent and treat the heart and brain blood vessel diseases such as brain blood supply insufficiency and arteriosclerosis and so on. Crawling is the main movement which most animals perform when they walk, run, jump and dash. Therefore the reptile and other four-feet walking animals have very few diseases with their heart and brain blood vessels. In addition, due to the lower heart position, the blood in lower limbs returns to heart more easily, thus the lower limb varicosity and hemorrhoids could be prevented.

Moreover, the way of breathing is changed when crawling. When standing, human breathe primarily through the chest. However when crawling, human breathe primarily through the abdomen. In abdominal breathing, the vertical motion scope of diaphragm is increased, the pulmonary alveolus is expanded, all kind of internal organs and blood vessels in abdomen also move rhythmically along with the breath frequency, the vital capacity is enlarged, the cardiopulmonary function is enhanced. Crawling movement is really a good exercise for fitness. However, the crawling movement is restricted by the space and place. The movement intensity is also hard to control. Particularly when crawling in outdoor, it may cause the damage to hands and knees without proper protection.

As is well known in the art, at present most fitness equipments are designed for stand-up or sit-up use, such as treadmill, elliptical and rower. These kind of fitness equipments cannot eliminate and overcome the above human body defects when people is in the upright posture.

There are some fitness equipments which can be used by people in prone posture, such as push-up, wheeled exerciser in prone posture (Chinese patent number CN200610074574.9) and so on. However, these fitness equipments are mainly used for strength training and do not allow the user's four limbs moving co-ordinately in prone posture and cannot exercise the user's lower back and abdomen or lower limbs with different load. They are also not suitable for the infirm and elderly people, especially, the upper limb disabled people. An exercise apparatus "the cardiovascular spine exerciser" (patent number CN1618488A, GB0326735.8, issued in the name of Zinnur Akhmetov) allows the user to perform the exercise in prone posture based on "fourlimbs". But the movement provided by this exerciser is not the crawling motion, it is just a four-limb swinging movement.

SUMMARY OF THE INVENTION

It is the object of the present invention to provide a crawling exerciser in prone posture that may be used to simulate an animal crawling motion.

The present invention provides the crawling exerciser including upper limbs support, left and right leg slides, track means and pulley and cable means. Wherein, the left and right leg slides are mounted wheels. The track means comprises two parallel tracks and track supports. The left and right tracks are fixed to the supports and there is a space between the tracks and ground. The upper limbs support are located at left and right tracks or track supports. The left and right leg slides are mounted on left and right tracks and movable on the tracks through said wheels. The pulley and cable means comprises pulleys and a cable. Said pulleys are mounted underneath the tracks and are connected by said cable. At least, the left and right leg slides are connected to the pulley and cable means.

The first embodiment of the present invention provides the crawling exerciser including upper limbs support, left and right leg slides, track means, and pulley and cable means, wherein, Said upper limbs support comprises left and right arm slides which are mounted with wheels through which the left and right arm slides can slide on said tracks. Left and right arm slides and left and right leg slides are interconnected by the pulley and cable means so that the left and right arm slides and left and right leg slides can move on left and right track to and fro either in phase or in opposite direction.

The second embodiment of the present invention provides the crawling exerciser including upper limbs support, left and right leg slides, track means, and pulley and cable means, wherein, Said upper limbs support comprises upper limbs carriage, left and right elbow supports and left and right handlebars; the upper limbs support located on track means, the left and right elbow supports and left and right handlebars mounted on upper limbs carriage and above said left and right tracks. Left and right arm slides and left and right leg slides are interconnected by the pulley and cable means so that the left and right arm slides and left and right leg slides can move on left and right tracks to and fro either in phase or in opposite direction.

The third embodiment of the present invention provides the crawling exerciser including upper limbs support, left and right leg slides, track means, and pulley and cable means, wherein, Said upper limbs support comprises left and right arm slides, upper limbs carriage, left and right elbow supports and left and right handlebars; the upper limbs carriage located above track means, the left and right elbow supports and left and right handlebars mounted on upper limb carriage and above said left and right tracks. Left and right arm slides and left and right leg slides are interconnected by the pulley and cable means so that the left and right arm slides and left and right leg slides can move on left and right track to and fro either in phase or in opposite direction.

Said pulley and cable means in second and third embodiment of the crawling exerciser provided by the present invention comprises at least two front pulleys mounted at front of the left and right tracks, at least two rear pulleys mounted at rear of the left and right tracks, at least four middle pulleys mounted at middle of the left and right tracks among them at least two of middle pulleys mounted in same axle.

The crawling exerciser provided by the present invention comprises a resistance means through which the resistance is adjustable.

The crawling exerciser provided by the present invention can be used when user's spine is in normal physiological and anatomical structure with normal load, namely in a free and relaxed "S"-shape level position and with "four limbs" facing downwards, to simulate an animal prone crawling motion. With its adjustable loading, it is suitable for various kinds of users with different physique and age, even for the upper limb disabled person. The user can specifically exercise his lower back and abdomen, pelvis and lower limbs with different load.

DETAILED DESCRIPTION OF THE PREFERRED EMBODIMENTS

Figure 1:
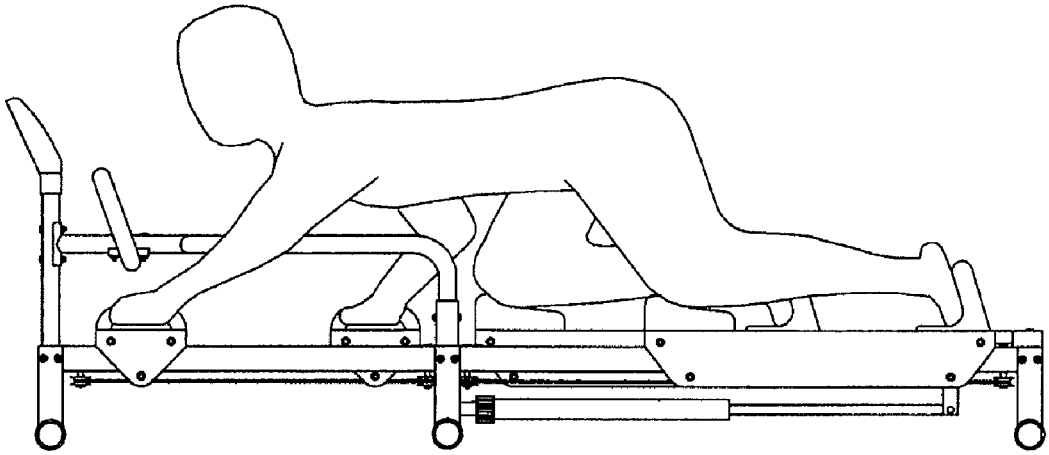
FIG. 1 is a schematic view of the crawling exerciser according to an embodiment of the present invention.

Referring to the drawings the present invention will now be described in detail by the way of the preferred embodiments of crawling exerciser.

FIG. 3 to FIG. 9 shows the basic structure of the preferred embodiments.

Figure 3:
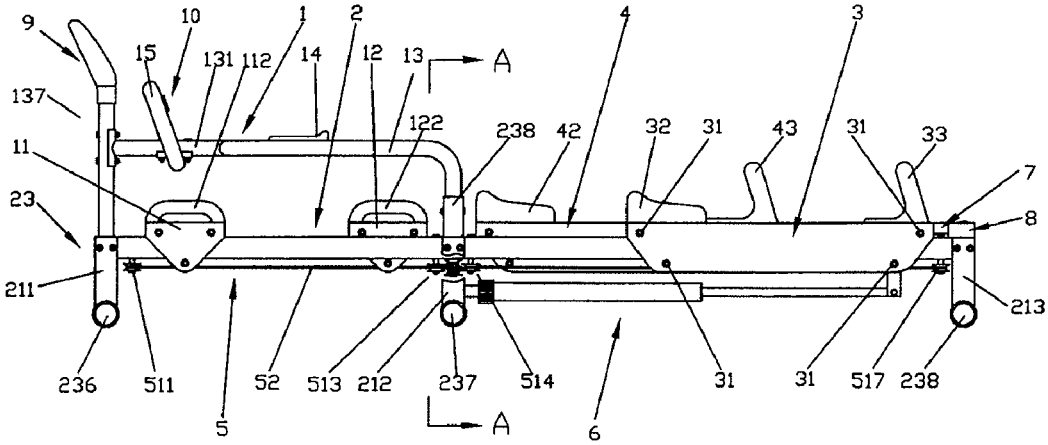
FIG. 3 is an elevation view of the preferred embodiment of the present invention.
Figure 4:
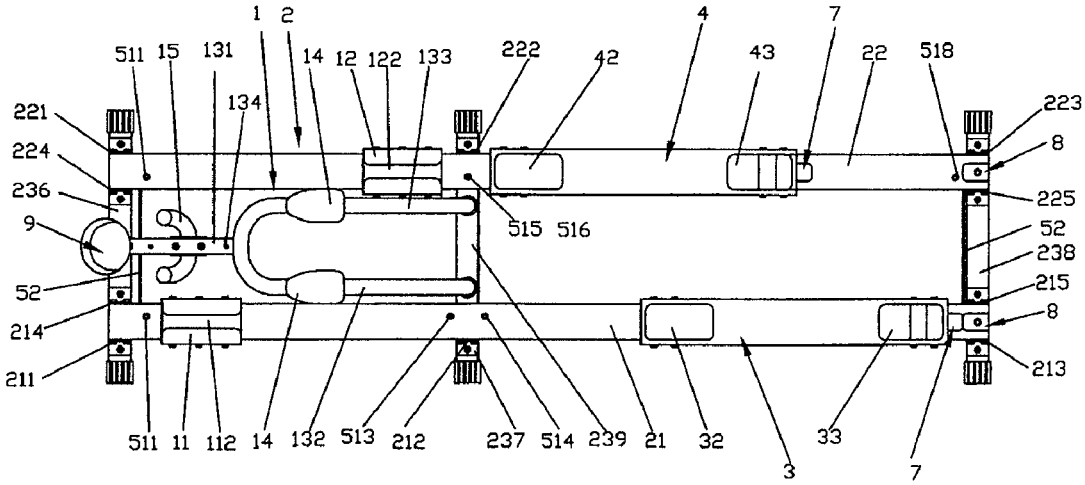
FIG. 4 is a top view of the preferred embodiment of the present invention.
Figure 5:
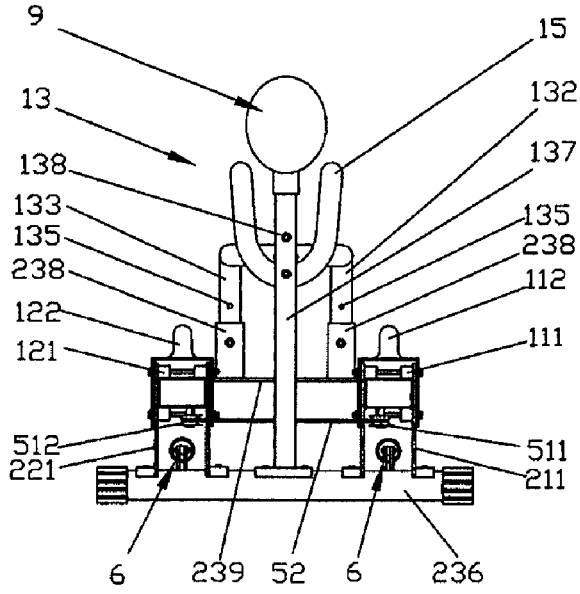
FIG. 5 is a front view of the preferred embodiment of the present invention.
Figure 6:
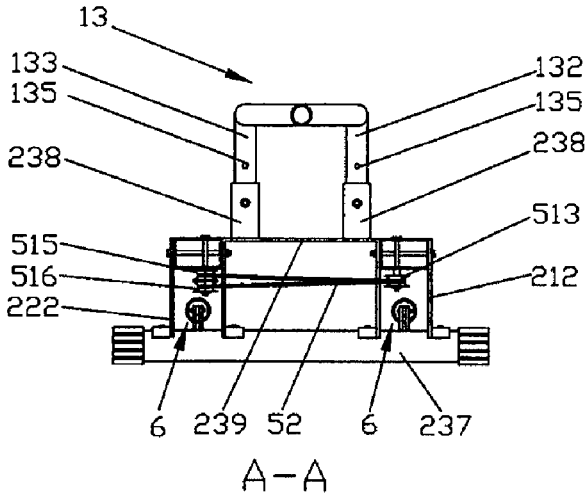
FIG. 6 is a section view taken generally along line A-A of FIG. 3.

Referring to FIG. 3 to FIG. 5, the present invention comprises upper limbs support 1 and left and right leg slides 3,4, track means 2 and pulley and cable means 5, wherein:

The track means 2 comprises left track 21, right track 22, track support 23 which composed of left track bracket 211, 212, 213, 214, 215, and right track bracket 221, 222, 223, 224, 225, and front cross bar 236, middle cross bar 237, rear cross bar 238 and middle support bar 239, wherein the left track 21 and right track 22 parallelly mounted to the track support 23.

Figure 9:
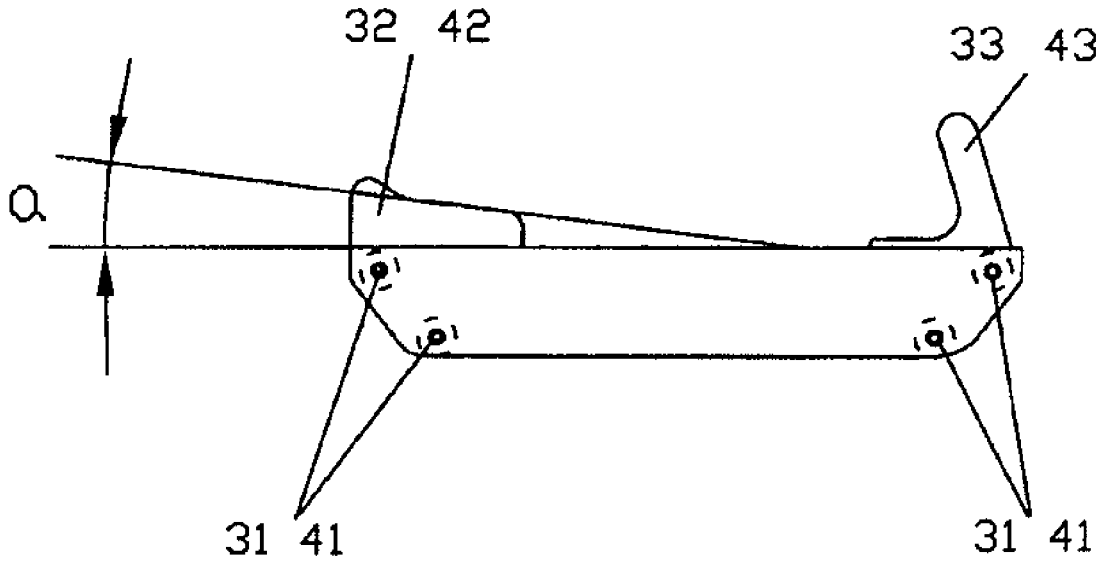
FIG. 9 is a detailed side view of leg slide according to the preferred embodiment of the present invention.

Each left and right leg slide 3, 4 is mounted 4 pairs of wheels with rim (4 pairs of wheels 31 in left leg slide, 4 pairs of wheels 41 in right leg slide), both left and right leg slides are mounted on corresponding track 21, 22 by means of said wheels so that both left and right leg slides 3, 4 can slide freely on said tracks without separating them from said tracks. The front portion of each leg slide includes a soft lining knee cushion pad (32, 42) which is higher enough and has a slope surface forming an angle "a" with said slide surface as shown in FIG. 9. The rear portion of each leg slide includes a footplate (33, 43) which can be adjusted forward or backward based on the length of user's leg.

Referring to FIG. 3, FIG. 4, a stop block 7 is mounted on the edge of rear portion of said left and right leg slide 3, 4, correspondingly a stop block 8 is mounted at the rear of left track 21 and right track 22. When the leg slides move backwards, the stop block 7 bumps against stop block 8 to limit the travel distance of the leg slide. The position of the stop blocks can be adjusted forward or backward so that the travel distance of the leg slide can be adjusted.

The structure type of the upper limbs support determines the type of crawling motion whether it is the whole body crawling movement or the half body crawling movement in which the lower limbs crawling while the upper limbs at rest. The three embodiments are given as following:

Referring to FIG. 1 in the first embodiment, applying the type of whole body crawling movement, the upper limbs support comprises left arm slide 11 and right arm slide 12, each arm slide is mounted 3 pairs of wheels with rim (3 pairs of wheels 111 in left arm slide, 3 pairs of wheels 121 in right arm slide), two pairs of wheels on the top of track while another under the track. Each left and right arm slide 11, 12 comprises a hand grip with soft lining to provide a grip for user.

Figure 7:
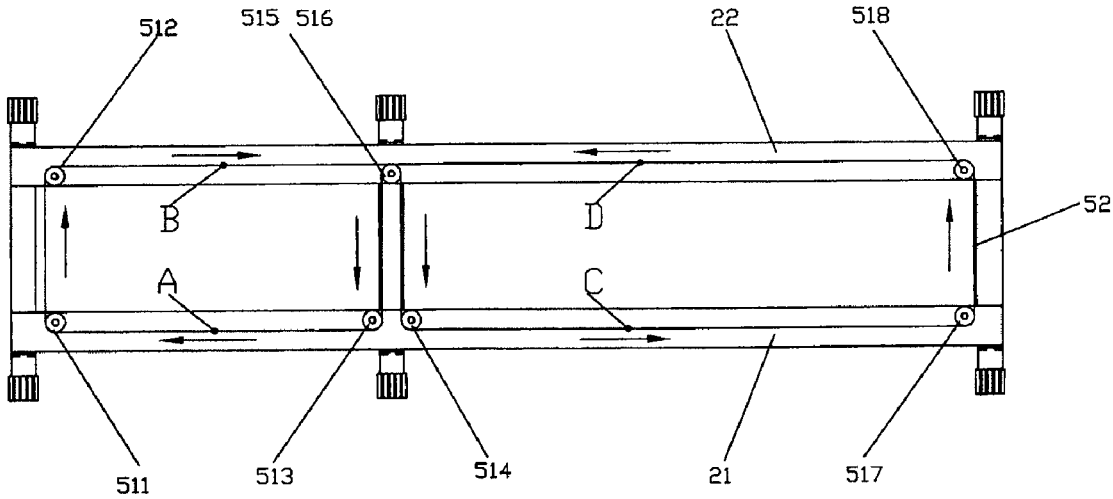
FIG. 7 is a diagrammatic view of the pulley and cable means according to the preferred embodiment of the present invention.
Figure 8:
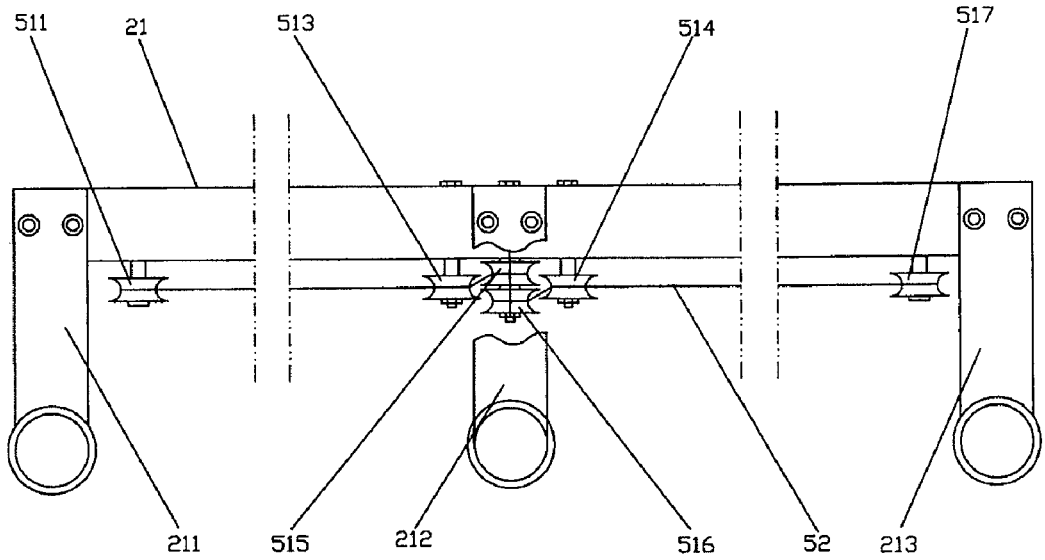
FIG. 8 is an elevation view of the pulley and cable means according to the preferred embodiment of the present invention.

In this embodiment, the pulley and cable means to be used is shown as FIG. 7 and FIG. 8. The pulley and cable means 5 consists of pulley 51 and cable 52. Pulley 51 comprises front pulley 511, 512, middle pulley 513, 514, 515, 516, rear pulley 517, 518, wherein the middle pulley 515, 516 is a pair of coaxial pulleys which are mounted up and down in same axle. Beginning from pulley 511 in front portion of left track, cable 52 reeves about pulley 512 in front portion of right track, turning at upper pulley 515, the upper pulley of coaxial pulleys in the middle of right track, back to left track and reeves about pulley 514 in middle of left track, then about pulleys 517,518 at rear portion of track, turning at pulley 516, the lower pulley of coaxial pulleys in the middle of right track, back to left track again and reeves about pulley 513 in middle of left track, finally returns to pulley 511 in front portion of left track.

Referring to FIG. 7, in the diagram, each point A, B, C, D represents respectively the left and right arm slide 21, 22 and the left and right leg slide 3,4. When point A on cable 52 moves forward, then point B moves backward. Simultaneously, point C moves backward, point D moves forward. In this way, not only the arm slides 11, 12 and the leg slides 3,4 can move forward and backward alternately, but also the arm slides and the leg slides can move in phase or in opposite phase. This motion sequence and the relative position make the crawling motion in coordination and similar to the animal crawling motion. The distance between arm slide 11, 12 and leg slide 3, 4, namely the crawling span or range can be adjusted by adjusting respectively the position of slides connected in cable 52.

This embodiment may be suitable for young people or people with good physique.

Figure 2:
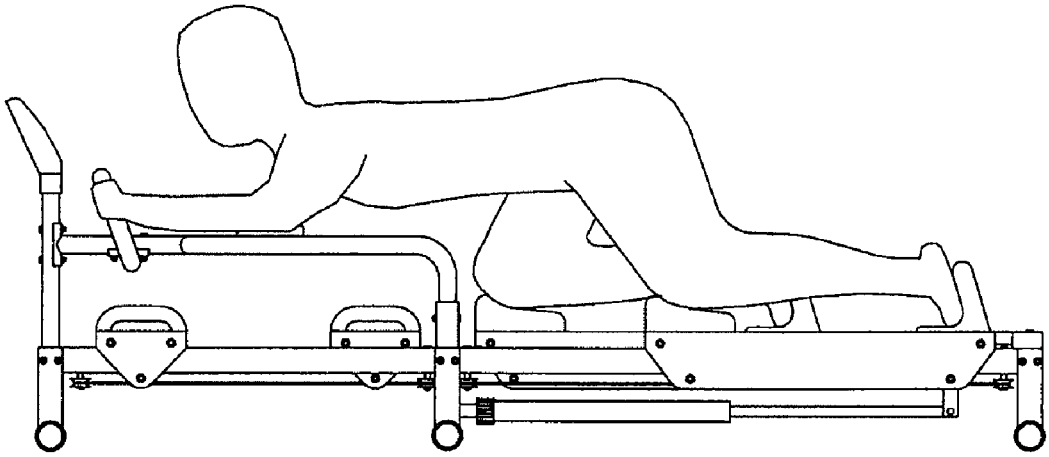
FIG. 2 is another schematic view of the crawling exerciser according to an embodiment of the present invention.

Referring to FIG. 2 in second embodiment, applying the type of half body crawling movement, the lower limbs crawling while the upper limbs at rest, the upper limbs support 1 comprise the upper limb carriage 13, left and right elbow supports 14 and left and right handlebars 15. The upper limbs carriage 13 is located above the front cross bar 236 and middle cross bar 237 of track means 2, and also above and between left and right tracks 21, 22. Said upper limb carriage 13 consists of an upright bar 137, a connecting bar 131 and the U shape left and right arm 132,133. Said left and right handlebars 15 mounted on connecting bar 131 which has adjusting holes 134 enabling handlebars 15 adjustable forward and backward. The vertical portion of said U shape left and right arm 132,133 inserts into the sleeve tubes 238 which are fixed to middle cross support plate 239. The other end of the U shape arms is fixed to the connecting bar 131. Said left and right elbow supports 14 with soft lining pad are respectively mounted on the left and right arms 132,133 on which there are adjusting holes 135. Said upright bar 137 has adjusting holes 138 which can be used to adjust the height of bar 131. By adjusting simultaneously both connecting bar 131 and left and right arm 132,133, the entire upper limb carriage 13 can be adjusted up and down so that left and right handle bars 15 and left and right elbow supports 14 can be adjusted up and down. In this embodiment, the pulley and cable means needs only four pulleys: two middle pulleys and two rear pulleys. The cable reeves about the four pulleys forming a hoop and connecting the left and right leg slide. Referring to FIG. 3, 4, 5, in this embodiment a display 9 with microcomputer programming is mounted on the top of upright bar 137. The pulse sensors 10 are mounted on left and right handle bars 15. This embodiment may be suitable for the people who is upper limb disabled or in weak health and cannot perform the whole body crawling movement.

Referring to FIG. 1 and FIG. 2, in third embodiment, user can perform both whole body crawling movement and lower limb crawling movement while upper limb at rest. In this embodiment the upper limb support 1 comprises all elements of upper limb support mentioned in first and second embodiment, and the mounting position of all elements maintain unchanged. The pulley and cable means 5 mentioned in first embodiment is applied.

When using the crawling exerciser of this embodiment, if the user feels tired after performing the whole body crawling movement he or she can change to the lower limb crawling movement while upper limb at rest, allowing the upper limb to rest. This embodiment suits all kind of users.

Referring to FIG. 3, 5, 6, in above said three embodiments, a resistance device 6 is mounted respectively underneath the left and right leg slide 3,4, which may be an air cylinder, hydraulic cylinder, a helical spring or the counter weight. In the preferred embodiment an air cylinder is used. One of its ends is fixed to the middle cross bar 237, while the other end is fixed to the leg slide. When the leg slide moves backwards, the piston-rod is pulled out from the cylinder to obtain the resistance. Referring to FIG. 4, a stop block 7 is respectively mounted at the rear of each left right leg slide 3, 4, and also a stop block 8 is respectively mounted at the rear of each left track 21 and right track 22. When the leg slide moves backwards, the stop block 7 will bump against the stop block 8 to limit the position of leg slide. The position of stop blocks 7, 8 can be adjusted forwards and backwards, thus the travel distance of leg slide can be adjusted.

The crawling exerciser of the present invention is used as follows:

First adjust

- required distance between left and right arm slide and the distance between left and right leg slide;
- required distance between soft lining kneepad and foot plate;
- required height between upper limps carriage and surface of tracks;
- required distance between handlebar and elbow support pad;
- required level of the training load.

To utilize the present invention, a user simply places his or her hands on the left and right arm of mentioned upper limp carriage; knees on the soft lining kneepad at front of leg slide; and foot on foot plate at rear of leg slide. Then places his or her hands down to the arm slides to grasp separately both hand grips. Now, the user places his or her whole body on the crawling exerciser in a prone position. Raising his or her head slightly and looking ahead, the user can simulate a crawling motion by moving alternatively his or her both hands and feet forward and backward. If a pulse test is required, or the upper limbs need resting and only the lower limbs crawling movement is required, the user may shift his or her hands from arm slides to handlebars (which are located in front of upper limp carriage and are mounted with pulse sensors). Grip the handlebars and place his or her both elbows against the left and right elbow support pads in upper limb carriage. By now, the upper portion of user's body in fact lies prone on the upper limb carriage. So long as moving alternatively his or her both feet forward and backward, the user can specifically exercise his or her lower back, abdomen and lower limb. This kind of lower limb crawling movement is especially suitable for elderly or infirm people who is too weak to support his or her upper body with hands, or for those who want specifically exercise his or her lower back, abdomen and lower limbs, even for the upper limb disabled people.

The health benefits of the present invention of crawling exerciser:

When using the crawling exerciser of the present invention to exercise, the spine is at free and relaxed "S" shaped natural prone position. The cervical vertebra, the thoracic vertebra and the lumbar vertebra are restored to the normal physiological and anatomical structure position; and the four limbs moves in coordination. Therefore, the user may obtain some unique effects as follows:

Enable the spine to obtain the complete exercise, improve the spine's pliability, stretchability and balance property, therefore might achieve the goal to prevent or treat the diseases related to spine such as strain of lumbar muscles, the sciatica, the cervical vertebra sickness and the lumbar vertebra.

Improve the blood supply to brain, enhances the brain oxygen content, eliminates the brain fatigue, beneficial for brain rest and brain health, not only enable people to be clear-headed, but also to see and hear well, the leg and foot to be nimble. It is extremely obvious to benefit the mental workers. Especially beneficial for prevention and auxiliary treatment of cardiovascular and brain diseases such as brain insufficiency blood supply and arteriosclerosis;

Beneficial for enabling the lower limb blood to return to heart and for prevention of lower limb varicosity and hemorrhoids;

Improve the vital capacity, enhanced the cardiopulmonary function;

Stimulate the brain, to stop and postpone brain cell degeneration process Beneficial for prevention of the senile dementia sickness.

What is claimed is:

1. A prone crawling exerciser, comprising:

an upper limb support;

left and right leg slides;

a track system; and a pulley and cable system;

wherein the left and right leg slides are each mounted on wheels;

wherein the track system comprises two parallel left and right tracks and track supports, wherein the left and right tracks are mounted on the track supports, and wherein the left and right tracks are spaced from underlying ground by the track supports;

wherein the upper limb support is mounted on the track system;

wherein the left and right leg slides are mounted on the left and right tracks and are configured to slide on the left and right tracks by the wheels;

wherein the pulley and cable system comprises a plurality of pulleys and at least one cable, wherein the pulleys are mounted on the track system, and wherein the cable reeves about the pulleys so as to connect at least the left and right leg slides; and wherein the left and right leg slides each comprise an adjustable resistance mechanism including at least one of air cylinders, hydraulic cylinders, a helical spring, and counter weights.

2. The prone crawling exerciser as claimed in claim 1, wherein upper limb support comprises:

left and right arm slides mounted on the left and right tracks and configured to slide on the left and right tracks by the wheels; and wherein a cable of the pulley and cable system connects the left and right arm slides and the left and right leg slides.

3. The prone crawling exerciser as claimed in claim 1, wherein the upper limb support comprises:

an upper support carriage, left and right elbow support pads, and left and right handlebars;

wherein the upper support carriage is mounted on the track system;

wherein the left and right elbow support pads and left and right handlebars are mounted on the upper support carriage and are located above left and right tracks; and wherein a cable of the pulley and cable system connects the left and right leg slides.

4. The prone crawling exerciser as claimed in claim 1, wherein the upper limb support comprises:

left and right arm slides, upper support carriage, left and right elbow support pads, and left and right handlebars;

wherein the upper support carriage is mounted above the track system;

wherein the left and right elbow support pads and the left and right handlebars are mounted on the upper support carriage and located above the left and right tracks;

wherein the left and right arm slides are mounted on wheels by which the left and right arm slides are configured to slide on the left and right tracks; and wherein a cable of the pulley and cable system reeves about the pulleys and connects the left and right arm slides and the left and right leg slides.

5. The prone crawling exerciser as claimed in claim 4, wherein the left and right arm slides each comprise a soft lining handgrip.

6. A prone crawling exerciser, comprising:

an upper limb support;

left and right leg slides;

a track system; and a pulley and cable system;

wherein the left and right leg slides are each mounted on wheels;

wherein the track system comprises two parallel left and right tracks and track supports, wherein the left and right tracks are mounted on the track supports and wherein the left and right tracks are spaced from underlying ground by the track supports;

wherein the upper limb support is mounted on the track system;

wherein the left and right leg slides are mounted on the left and right tracks and are configured to slide on the left and right tracks by the wheels;

wherein the pulley and cable system comprises a plurality of pulleys and at least one cable, wherein the pulleys are mounted on the track system, and wherein the cable reeves about the pulleys so as to connect at least the left and right leg slides; and wherein left and right leg slides each comprise a soft lining knee pad mounted at a front portion of each leg slide and a footplate mounted at a rear portion of each leg slide, wherein the footplate can be adjusted forward or backward based upon the length of a user's leg.

7. The prone crawling exerciser as claimed in claim 1, wherein the plurality of pulleys in the pulley and cable system comprise:

at least two front pulleys mounted at a front portion of the left and right tracks;

at least two rear pulleys mounted at a rear portion of the left and right tracks;

at least four middle pulleys mounted in a middle of the left and right tracks, wherein at least two of the middle pulleys are mounted along the same axle;

wherein the cable in the pulley and cable system reeves about the plurality of pulleys and connects the left and right arm slides and left and right leg slides and enables the left and right arm slides and the left and right leg slides to move to and fro on the left and right tracks either in phase or in opposite directions.

8. The prone crawling exerciser as claimed in claim 3, wherein the upper carriage comprises adjusting holes configured to adjust the position of the left and right elbow support pads and the left and right handlebars forwards and backwards, and further comprises adjusting holes to adjust the position of left and right elbow support pads and left and right handlebars upwards and downwards.

9. The prone crawling exerciser as claimed in claim 1, further comprising:

first stop blocks at a rear portion of each of the left and right leg slides; and second stop blocks at a rear portion of the left track and the right track;

wherein the first and second stop blocks are configured to absorb shock and limit the distance of travel of the left and right leg slides;

wherein the first and second stop blocks are adjustable forwards and backwards.

10. The prone crawling exerciser as claimed in claim 6, wherein each of the knee pads is mounted onto the surface of the left and right leg slides with a selected height and forms an angle (a) with the surface of left and right leg slides.

11. The prone crawling exerciser as claimed in claim 3, wherein the upper carriage comprises a display comprising microcomputer programming mounted on the top of upright bar.

12. The prone crawling exerciser as claimed in claim 3, wherein the left and right handlebars each comprises a hand pulse sensor.

13. A prone crawling exerciser, comprising:

an upper limb support;

left and right leg slides;

a track system; and a pulley and cable system;

wherein the left and right leg slides are each mounted on wheels;

wherein the track system comprises two parallel left and right tracks and track supports, wherein the left and right tracks are mounted on the track supports, and wherein the left and right tracks are spaced from underlying ground by the track supports;

wherein the upper limb support is mounted on the track system;

wherein the left and right leg slides are mounted on the left and right tracks and are configured to slide on the left and right tracks by the wheels; and wherein the pulley and cable system comprises a plurality of pulleys and at least one cable, wherein the pulleys are mounted on the track system, and wherein the cable reeves about the pulleys so as to connect at least the left and right leg slides.

14. The prone crawling exerciser as claimed in claim 13, wherein the upper carriage comprises adjusting holes configured to adjust the position of the left and right elbow support pads and the left and right handlebars forwards and backwards, and further comprises adjusting holes to adjust the position of left and right elbow support pads and left and right handlebars upwards and downwards.

15. The prone crawling exerciser as claimed in claim 13, wherein the upper carriage comprises a display comprising microcomputer programming mounted on the top of upright bar.

16. The prone crawling exerciser as claimed in claim 13, wherein the left and right handlebars each comprises a hand pulse sensor.

17. The prone crawling exerciser as claimed in claim 13, wherein left and right leg slides each comprise a soft lining knee pad mounted at a front portion of each leg slide and a footplate mounted at a rear portion of each leg slide, wherein the footplate can be adjusted forward or backward based upon the length of a user's leg.

18. The prone crawling exerciser as claimed in claim 17, wherein the upper carriage comprises adjusting holes configured to adjust the position of the left and right elbow support pads and the left and right handlebars forwards and backwards, and further comprises adjusting holes to adjust the position of left and right elbow support pads and left and right handlebars upwards and downwards.

* * * * *